US008529086B2

(12) United States Patent
Skrivan et al.

(10) Patent No.: US 8,529,086 B2
(45) Date of Patent: Sep. 10, 2013

(54) SYSTEMS AND METHODS FOR LOCKING A PORTABLE ILLUMINATION SYSTEM

(75) Inventors: Joseph Skrivan, Draper, UT (US); Douglas Heinrich, Salt Lake City, UT (US); Jeremy Allen Saxton, Draper, UT (US); Christopher Best, Park City, UT (US)

(73) Assignee: Black Diamond Equipment Ltd., Salt Lake City, UT (US)

( * ) Notice: Subject to any disclaimer, the term of this patent is extended or adjusted under 35 U.S.C. 154(b) by 224 days.

(21) Appl. No.: 12/979,068

(22) Filed: Dec. 27, 2010

(65) Prior Publication Data

US 2011/0204826 A1 Aug. 25, 2011

Related U.S. Application Data

(60) Provisional application No. 61/307,127, filed on Feb. 23, 2010.

(51) Int. Cl.

| | |
|---|---|
| ***F21L 4/02*** | (2006.01) |
| ***F21L 4/00*** | (2006.01) |
| ***F21V 33/00*** | (2006.01) |
| ***F21K 2/00*** | (2006.01) |
| ***H01H 35/00*** | (2006.01) |
| ***H01H 83/00*** | (2006.01) |

(52) U.S. Cl.
USPC ..... 362/184; 362/157; 362/212; 307/116

(58) Field of Classification Search
USPC ..... 362/5, 43, 50, 212, 151–200; 200/1 B, 200/60, 4, 5 R, 6 A, 17 R, 18
See application file for complete search history.

(56) References Cited

U.S. PATENT DOCUMENTS

| | | | | |
|---|---|---|---|---|
| 5,138,538 | A * | 8/1992 | Sperling | 362/205 |
| 6,357,893 | B1 * | 3/2002 | Belliveau | 362/285 |
| 6,979,099 | B2 * | 12/2005 | Harris et al. | 362/184 |
| 7,261,433 | B2 * | 8/2007 | Parsons et al. | 362/205 |
| 7,513,660 | B2 * | 4/2009 | Spartano et al. | 362/373 |
| 2006/0072306 | A1 * | 4/2006 | Woodyard | 362/157 |
| 2009/0190338 | A1 * | 7/2009 | Huang | 362/184 |

FOREIGN PATENT DOCUMENTS

| | | |
|---|---|---|
| JP | 11316553 | 11/1999 |
| JP | 200172430 | 6/2000 |
| JP | 2008009009 | 1/2008 |
| KR | 1020070029236 | 3/2007 |

* cited by examiner

*Primary Examiner* — Jon-Suk (James) Lee
*Assistant Examiner* — Alexander Garlen
(74) *Attorney, Agent, or Firm* — Baker & Associates PLLC; Trent Baker

(57) ABSTRACT

One embodiment of the present invention relates to a portable illumination system having a locked state that minimizes unintended activation. The system includes a first activated state, deactivated state, and locked state. The first activated state generates a first optical output via the optical output device. The deactivated state deactivates the optical output device. The locked state also deactivates the optical output device. The system further includes a switching mechanism configured to receive a first and second physical user input and an algorithm of operation for each of the states. The algorithms of operation for the first activated state and the deactivated state correlate the first and second physical user inputs with a state change between the first activated state, deactivated state, and locked state. The algorithm of operation for the locked state is restricted in that it correlates only the second physical user input with a state change.

19 Claims, 2 Drawing Sheets

SYSTEMS AND METHODS FOR LOCKING A PORTABLE ILLUMINATION SYSTEM

RELATED APPLICATIONS

This application claims priority to U.S. provisional application Ser. No. 61/307,127 filed Feb. 23, 2010, the contents of which are incorporated by reference.

FIELD OF THE INVENTION

The invention generally relates to portable illumination systems. In particular, the present invention relates to system and methods for operationally locking a portable illumination system.

BACKGROUND OF THE INVENTION

Illumination systems selectively transmit a region or field of illumination that may be used for a variety of purposes. The illuminated region may be used to provide various forms of light to assist a user in performing visual tasks and/or designating a location for others. For example, a headlamp is an illumination system which is commonly coupled to a user's head and is used to illuminate a region in alignment with the orientation of the user's head. Likewise, a flashlight is a handheld illumination system which illuminates a region in alignment with the user's hand. Both headlamps and flashlights are sized and configured to be portable to allow users to conveniently bring them to a variety of locations.

Electrical based illumination systems include some form of user-based switching system to enable selective user activation. In general, a switching system includes selectively coupling an optical output device with an electrical power source. A switching system includes both a mechanical switching mechanism and an algorithm. Various well known forms/styles of mechanical switching mechanisms may be used including slider, pushbutton, rotation, etc. The algorithm of the switching system correlates particular physical operations of the switching mechanism with particular electrical responses and/or outputs. For example, an algorithm may include correlating the relative rotational positioning of a rotational switching mechanism with the amount of current transmitted to the optical output device thereby affecting the intensity of the illumination output. The active capacity of an electrical-based illumination system is finite, and therefore it is necessary to only activate the illumination system during use. Portable illumination systems are often stored during periods of non-activation. For example, a non-active headlamp or flashlight may be positioned in a backpack or pocket for storage purposes.

One of the problems with conventional portable illumination systems is the incidence of inadvertent or undesirable activation. An undesirable activation may discharge the capacity of the illumination system such that upon subsequent user activation, the power source is exhausted. The cause of an undesirable activation corresponds to the switching system configuration and the nature of the location at which the system is stored. For example, an illumination system that includes a rotational type switching mechanism with a basic activation algorithm may be inadvertently activated as a result of frictional contact with other objects. However, an overly complex or physically sheltered switching mechanism and algorithm is also undesirable because it impedes a user from intuitively and efficiently activating the illumination system. Conventional portable illumination systems fail to include switching systems which are both efficient and provide minimal undesirable activation.

Therefore, there is a need in the industry for systems and methods of operationally locking a portable illumination system.

SUMMARY OF THE INVENTION

The present invention relates to portable illumination systems. One embodiment of the present invention relates to a portable illumination system having a locked state that minimizes the occurrence of unintended activation. The system includes an optical output device and an electrical power source such as one or more LEDs and one or more direct current batteries, respectively. The system further includes a first activated state, deactivated state, and locked state. The first activated state comprises an electrical coupling between the electrical power source and the optical output device so as to generate a first optical output via the optical output device. The deactivated state comprises an electrical decoupling between the electrical power source and the optical output device so as to deactivate the optical output device. The locked state also comprises an electrical decoupling between the electrical power source and the optical output device so as to deactivate the optical output device. The system further includes a switching mechanism configured to receive a first and second physical user input and an algorithm of operation for each of the states. The algorithms of operation for the first activated state and the deactivated state correlate the first and second physical user inputs with a state change between the first activated state, deactivated state, and locked state. The algorithm of operation for the locked state correlates only the second physical user input with a state change to prevent unintended activation through the first user input. A second embodiment of the present invention relates to a method or algorithm of operation for a portable illumination system.

Embodiments of the present invention represent a significant advance in the field of portable illumination systems. Conventional portable illumination systems include switching mechanisms and/or algorithms of operations which allow for an undesirably high incidence of inadvertent activation. For example, a rotational switching mechanism which includes an algorithm of activation based on rotational positioning may easily be activated in a storage location as a result of rubbing with other items. Likewise, conventional portable illumination systems with cumbersome switching mechanisms are undesirable. Embodiments of the present invention provide systems and methods which facilitate the locking of a portable illumination system in a state that does not discharge the power source and only responds to a limited number of physical user inputs. The limited physical user inputs may therefore be specifically selected to avoid inadvertent activation. In accordance with one embodiment of the present invention, a portable illumination system with a push button switching mechanism which responds to both short push and long push type physical user inputs may include a locked state in which an algorithm is configured to ignore short push and only respond to long push type physical user inputs.

In addition, embodiments of the present invention represent an advance over portable illumination systems with a mechanical lock mechanism. Certain conventional switching systems include some form of mechanical lockout which prevents user input such as the inclusion of a cover or sleeve over the switching mechanism. While mechanical lockout systems prevent some inadvertent activation, they cannot be sealed for purposes of water or weatherproofing. Therefore, by including the lockout functionality into the operational algorithm, embodiments of the present invention may be waterproof or weatherproof by sealing the switching mechanism.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1A:
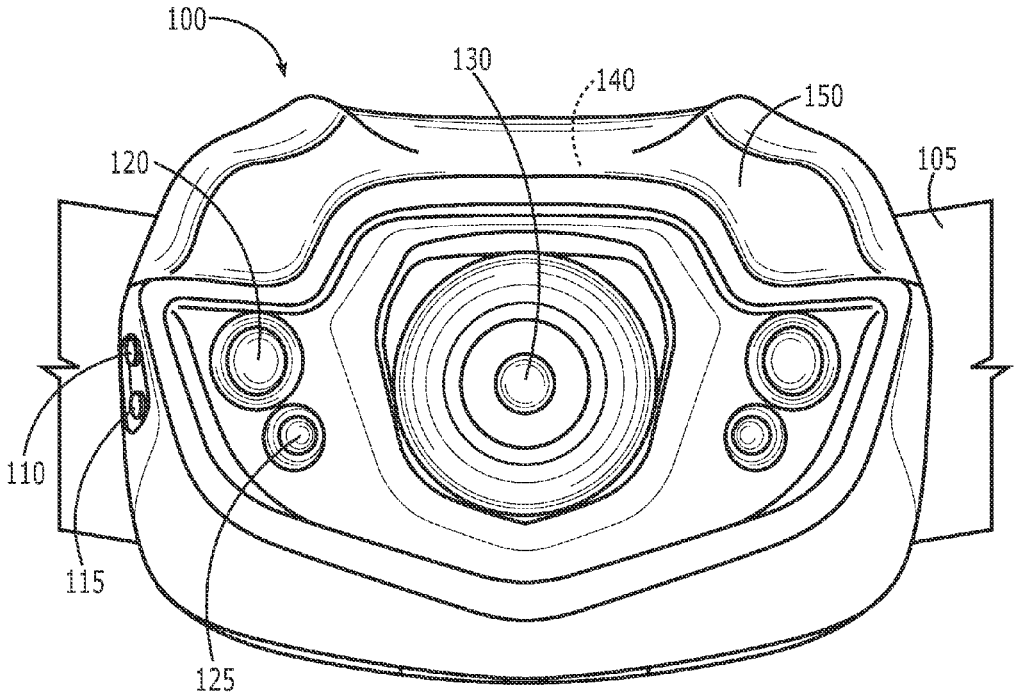
FIG. 1A illustrates a front view of a portable illumination system of the headlamp type equipped with a push button switching mechanism, along with an operational algorithm that includes a locked state in accordance with embodiments of the present invention.

The present invention relates to portable illumination systems. One embodiment of the present invention relates to a portable illumination system having a locked state that minimizes the occurrence of unintended activation. The system includes an optical output device and an electrical power source such as one or more LEDs and one or more direct current batteries, respectively. The system further includes a first activated state, deactivated state, and locked state. The first activated state comprises an electrical coupling between the electrical power source and the optical output device so as to generate a first optical output via the optical output device. The deactivated state comprises an electrical decoupling between the electrical power source and the optical output device so as to deactivate the optical output device. The locked state also comprises an electrical decoupling between the electrical power source and the optical output device so as to deactivate the optical output device. The system further includes a switching mechanism configured to receive a first and second physical user input and an algorithm of operation for each of the states. The algorithms of operation for the first activated state and the deactivated state correlate the first and second physical user inputs with a change between states. Possibilities include the first activated state, deactivated state, and locked state. The algorithm of operation for the locked state correlates only the second physical user input with a state change to prevent unintended activation through the first user input. A second embodiment of the present invention relates to a method or algorithm of operation for a portable illumination system. Also, while embodiments are described in reference to a portable illumination system, it will be appreciated that the teachings of the present invention are application to other areas including but not limited to cell phones, cameras, and other portable electronic systems which utilize a finite power source.

The following terms are defined as follows:

Definitions

Physical user input—a physical motion or action by a user; examples include sliding, pushing, touching, holding, etc. A particular switching mechanism may respond to one or more independent types of physical user inputs. For example, a push button switching mechanism may respond differently to a short push versus a long push. Likewise, a rotational switching mechanism may respond differently to a 90 degree rotation versus a 180 degree rotation.

Switching mechanism—a hardware mechanism configured to receive one or more physical inputs from a user. A switching mechanism may include a single switch or multiple switches to facilitate the ability to differentiate between one or more physical user inputs. For example, a switching mechanism configured to respond to dual physical user inputs can be comprised of two switches or a single switch configured to differentiate between two different types of physical user inputs.

Optical output device—any module configured to transmit an optical output in response to an input. For example, a light emitting diode (LED) is an electrical-based optical output device that transmits a particular optical output in response to an electrical input.

Algorithm—a logical response profile correlating user inputs upon a switching mechanism and electrical configurations between a power source and an optical output device. The algorithm may be programmed onto a printed circuit board (PCB) or other types of electrical data storage and operation device.

Portable illumination system—an illumination system configured to be efficiently transported by a user, including but not limited to flashlights, headlamps, and illumination systems with corresponding form factors.

States of operation—particular configurations of a portable illumination system corresponding to particular output modes. For example, an activated state may correspond to generating an illumination output while a deactivated state may correspond to preserving a finite power source by not generating an illumination output. The terms "activated state", "deactivated state", and "locked state" are used generally to describe fundamental concepts. It will be appreciated that each state may include various sub-states or may be replaced by multiple states. For example, the technical appendix describes numerous activated states involving various optical output device combinations, illumination frequency patterns, intensity levels, etc. The states of operation may be configured and controlled by a printed circuit board (PCB) or similar electrical data storage and operation device.

Figure 1B:
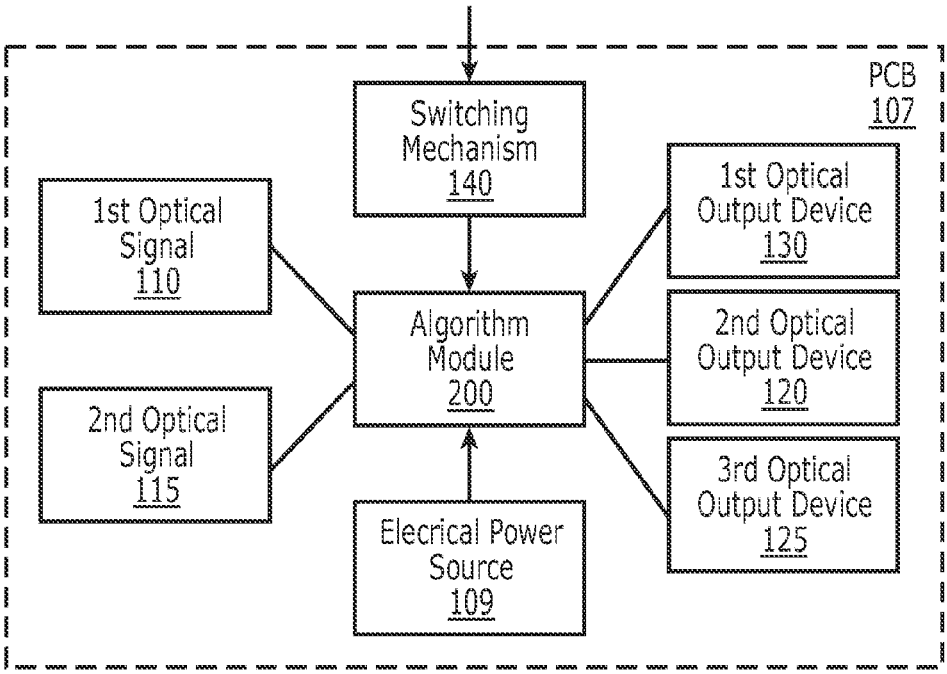
FIG. 1B illustrates a schematic module based electrical diagram of a printed circuit board disposed within the system illustrated in FIG. 1A.

Reference is initially made to FIGS. 1A and 1B, which illustrate a headlamp type portable illumination system in accordance with embodiments of the present invention, designated generally at 100. In particular, FIG. 1A illustrates an external front view of the system 100 and FIG. 1B illustrates an internal module based schematic of the printed circuit board portion of the system 100. The illustrated portable illumination system 100 is a headlamp type electrical based illumination system that includes a plurality of independent states or modes of operation. Conventional portable illumination systems all include both active and inactive states (i.e. ON and OFF states) corresponding to illumination output and power conservation, respectively. Embodiments of the present invention further include a locked state that restricts the types of user input to which the system responds, so as to minimize and/or prevent inadvertent engagement of one of the active states.

Figure 2:
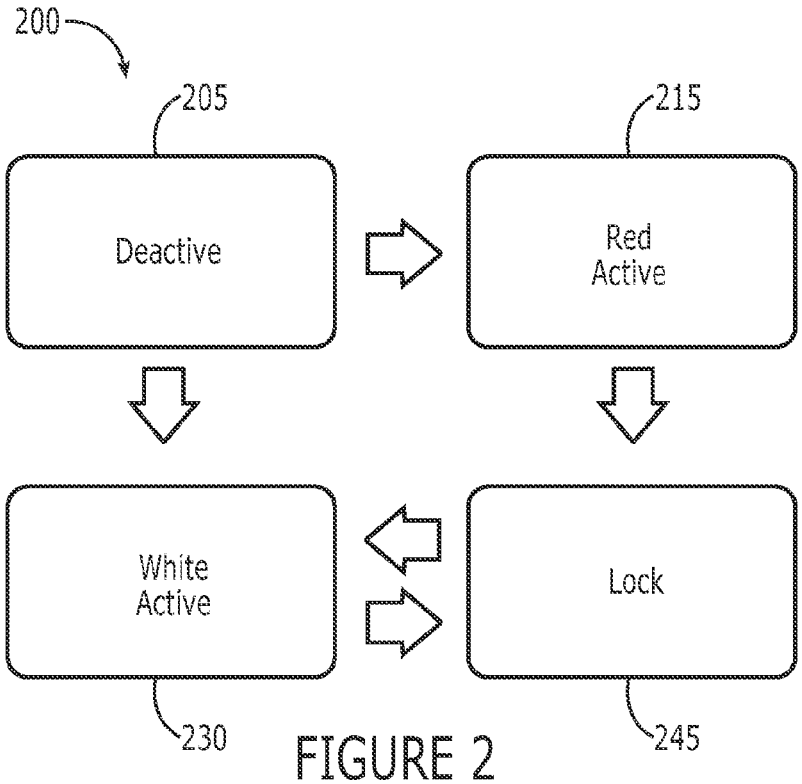
FIG. 2 illustrates a flow chart of a simplified operational algorithm corresponding to one alternative embodiment of the illustrated portable illumination system of FIGS. 1A and 1B.

The system 100 includes a printed circuit board 107 within a housing 150. The printed circuit board 107 further includes a switching mechanism 140, an electrical power source 109, and an algorithm of operation 200 (see FIG. 2). The system 100 further includes a plurality of independent operational states corresponding to different optical output parameters. The switching mechanism 140 and algorithm 200 affect the particular operational state of the system 100. The algorithm 200 controls the operational states of the system 100 and is represented by an algorithm module 200 disposed within the printed circuit board (PCB) 107. It will be appreciated that the actual logic of the algorithm 200 may be programmed into some form of integrated circuit or processor module. A simplified state diagram of the algorithm 200 and corresponding operational states is illustrated in FIG. 2. The exact methodology of switching for the illustrated embodiment will be described in sufficient detail for one skilled in the art with reference to the technical appendix below. The switching mechanism 140 for the illustrated embodiment includes a single push-button type switch configured to respond to two different types of physical user inputs, including a short push and a long push/hold. The difference between the short push and the long push corresponds to the length or duration of pressure applied to the switching mechanism by the user. For example, a short duration of pressure corresponds to a short push, and a long duration of pressure corresponds to a long push. The finite pressure timing may be adjusted depending on the application. It will be appreciated that various alternative switching mechanism configurations and switch types may be utilized in accordance with embodiments of the present invention. For example, two or more separate switches may also be used to distinguish between the two different physical user inputs. Likewise, a slider or rotational type switch may also be utilized. The illustrated system 100 further includes an elastic head type strap 105 for hands-free user attachment. It will be appreciated that various form factors of portable illumination systems may be practiced in accordance with embodiments of the present invention, including but not limited to flashlights, non-headlamp illumination systems, mountable illumination systems, and similar sized electronic illumination devices.

The system 100 further includes a first optical output device 130, a second optical output device 120, and a third optical output device 125. The optical output devices 130, 120, 125 each generate a unique illumination output corresponding to a particular activated state of the system 100. The optical output devices 130, 120, 125 are intercoupled with the electrical power source via the algorithm module 200 on the PCB 107. The first optical output device 130 is a high intensity white LED that produces a particular illumination output in a white activated state of the system 100. It will be appreciated that each activated state and/or illumination output may include one or more sub-states, including but not limited to multiple flashing frequencies, multiple brightness levels, etc. The second optical output device 120 is a set of two low intensity LEDs that produce a particular illumination output in a second white activated state of the system 100. The third optical output device 125 is a set of two red LEDS that produce a particular illumination output in a red activated state of the system 100. Various types of optical output devices may be utilized to effectuate particular objectives, including but not limited to alternative optical wavelengths, conservation of electrical power, etc. The optical output devices 130, 120, 125 are intercoupled with the switching mechanism 140, and the electrical power source 109 via the algorithm module 200.

The system 100 further includes a first optical signal 110 and a second optical signal 115. The first and second optical signal 110, 115 may be generated by one multi-colored LED or may be separated as illustrated. The first optical signal 110 indicates when the system 100 is in the locked operational state. The first optical signal 110 may correspond to a temporary blue colored illumination output of the LED when the system 100 engages the locked state. The first optical signal 110 therefore visually communicates to the user that the locked state has been engaged. The second optical signal 115 may correspond to a temporary illumination output with a spectral color of the LED corresponding to the capacity of battery storage in the electrical power source 109. The second optical signal 115 may also be configured to temporarily emit the spectral color upon any state change of the system 100 to provide the user with a visual indication of the remaining power in the electrical power source 109. The optical signals 110, 115 are intercoupled with the electrical power source 109 via a printed circuit board 107. It will be appreciated that the first and second optical signals 110, 115 may alternatively be generated by a plurality of LEDs.

FIG. 1B illustrates an electrical schematic of the printed circuit board 107 disposed within the housing 150 of the system. The algorithm 200 is electrically positioned between the switching mechanism 140, the electrical power source 109, and the various optical outputs and signals 130, 120, 125, 110, 115. Therefore, in response to one of two user inputs at the switching mechanism 140, the algorithm 200 will selectively electrically couple or decouple the electrical power source 109 with one or more of the optical outputs and signals 130, 120, 125, 110, 115. The algorithm module 200 generates a unique response to each of the two user inputs depending on the current state of operation. FIG. 2 illustrates a simplified embodiment of various algorithms of operation for each of the operational states of the system 100. Further discussion of specific algorithms for each state of operation will be addressed below in the technical appendix.

Reference is next made to FIG. 2, which illustrates a flow chart of a simplified operational algorithm in accordance with an alternative embodiment of the present invention. The illustrated simplified algorithm 200 is provided for explanation of the underlying fundamental concept and is not an accurate representation of the algorithm of operation for the embodiment illustrate in FIGS. 1A and 1B. The algorithm 200 is programmed to correlate physical user inputs from a switching mechanism with the selective engagement of one of the operational states of the system depending on the current operational state of the system. The simplified algorithm illustrated in FIG. 2 includes at least a deactivated state 205, white active state 230, a red active state 215, and a locked state 245. The deactivated state 205 corresponds to an electrical decoupling between the power source and any of the optical output devices. The locked state 245 also corresponds to an electrical decoupling between the power source and any of the optical output devices. Therefore, there is no long term optical output in the deactivated or locked state 205, 245. The deactivated and locked state 205, 245 thereby preserves the finite electrical power supply by not utilizing power to generate a significant optical output of any type. The white active state 230 corresponds to an electrical coupling between the power source and the first or second optical output device 130, 120 so as to generate a continuous white illumination output. The optional red active state 215 corresponds to an electrical coupling between the power source and the third optical output device 125 so as to generate a continuous red illumination output. It will be appreciated that the red active state 215 is optional, and therefore the operational algorithm may alternatively include a direct state change from the deactivated state 205 to the lock state 245. In addition, it will be appreciated that various other additional active states and/or sub-active states may be included in accordance with embodiments of the present invention.

The algorithm 200 selectively couples particular physical user inputs in each of the states with particular state changes. The locked state 245 includes a restricted response algorithm that only permits a state change in response to a long push type physical user input. The unique response restriction in the locked state 245 prevents inadvertent switching into an active state. For example, a short push upon the switching mechanism may be effectuated inadvertently by a non-user in a storage configuration. Therefore, while both the deactivated and locked states 205, 245 conserve power, only the locked state 245 also restricts the response algorithm to avoid inadvertent activation.

Additional operational algorithm variables and sequences may be included. The system may be configured to default to a particular state when other events occur such as replacing the battery, expiration of battery, expiration of illumination device, etc.

It will be appreciated that a user may optionally activate either the white active 230 or red active 215 states directly from the deactivated state 205 without sequentially activating the other active state. For example, a user may directly activate the red active 215 state from the deactivated state 205 by holding a switching mechanism for a specified duration. If the switching mechanism is release prior to the specified duration and/or prior to the activation of the red active 215 state, the white active state 230 may be activated. The ability to directly activate either of the activated states is particularly important for both efficiency and discretion.

Reference is next made to the technical appendix, which describes the technical specifications of the electrical components incorporated in the embodiment illustrated in FIG. 1. The technical appendix describes in further detail actual technical specifications of the illustrated embodiment in FIG. 1.

Technical Appendix

User Interface and Modes

The unit will have two sets of white LEDs (a main-load) LED and 2×5 mm white LEDs), as well as 2× red LEDs. The two sets of white LEDs will work in the Indexing mode. Thus each time a load is turned off, and the unit is turned on again, the next load will be selected. Both sets of white LEDs will have gradual dimming, and the 2×5 mm white LEDs will have flashing. The 2× red LEDs will have only HI Power mode, and flashing mode. To select the 2× red LEDs, the switch must be pressed continuously for $T_{toggle}$ from off mode. To return again to the white LEDs, the switch must once again be pressed for $T_{toggle}$ in off mode. To enhance functionality, there will also be a lockout mode, to disable turning on of the LEDs, when, for instance, the unit is being travelled with.

Indexing Mode (White LEDs Mode)

The two sets of white LEDs will work in the Indexing mode. Thus each time a load is turned off, and the unit is turned on again, the next load will be selected. As the software will be checking for a long press (to switch to 2× red LEDs), the loads will only turn on upon the release of the switch. When the loads are turned on, they will always turn on in HI Power mode.

When the batteries are removed, the unit will reset. In this instance, the unit will turn on with the Rebel LED. If the strobe mode was active when the unit was turned off (2×5 mm white LEDs), on the next switch press the unit will turn on with the Rebel LED, but not in strobe mode.

Red LED Mode

To select the 2× red LEDs, the unit must be off. The switch must be pressed for $T_{toggle}$, after which the 2× red LEDs will turn on. The 2× red LEDs will remain the active load until the switch is again pressed for $T_{toggle}$ or if the batteries are removed from the unit. As the 2× red LEDs do not have a gradual dimming interface, if the switch is pressed with the 2× red on, the 2× red will turn off immediately. If the switch is kept pressed after the 2× red LEDs have turned off, it will be ignored until the switch is released.

Flashing Mode

Both the 2×5 mm white LEDs and 2× red LEDs can be set into flashing mode. For both sets of LEDs the unit must first be set into the appropriate color mode. To select the flashing mode, the unit must be off. From off mode the switch must then be pressed 3 times within one second to access the flashing mode.

Detail: On the first press release the appropriate load will turn on, and on the second press the load will turn off. On the third press the appropriate load will start to flash.

Gradual Dimming Mode

Gradual dimming will work for both the Rebel LED and 2×5 mm white LEDs. A long press ($T_{PRESS}>T_{dim}$) will make Gradual Dimming mode active:

This mode employs a gradual decrease or increase in power to the load, from the highest power to the lowest power and back to the highest power, repeating indefinitely while a user presses the switch. For $T_{dim}$ after the switch is pressed, the load Power is not changed. After $T_{dim}$, the power to the load will immediately start to decrease, and after $T_{ramp\ down}$ the power to the load will reach a minimum of $PWM_{min}$. On reaching this minimum brightness level, a brief flash of duration $T_{flash}$, whereby the load is switched OFF, indicates to the user that the minimum brightness has been reached. On completion of this flash, the power to the load will stay at the minimum power for $T_{low}$, after which the power will start increasing, reaching HI Power in $T_{ramp\ up}$. Upon reaching HI Power, a brief flash of duration $T_{flash}$, whereby the load is switched OFF, indicates to the user that the maximum brightness level has been reached. Upon completion of this flash, the load will stay at HI Power for $T_{high}$, after which the power to the load will start to decrease again. This process can be repeated indefinitely. Gradual Dimming can be halted at any point by releasing the switch. The load will now remain at the dimmed level. A short press ($<T_{dim}$) will switch the load OFF, while a long press ($>T_{dim}$) will activate Gradual Dimming again from the current dimmed level on the load, and will slew in the same direction that was active before Gradual Dimming was halted.

Lockout Mode

Lockout mode is used to prevent the light to turn on accidentally, for instance during transit.

Entering Lockout Mode

To enter into lockout mode, the unit must be set to the white LED mode, and turned off. The switch must now be pressed and kept pressed. After $T_{toggle}$ the 2× red LEDs will light up, and after an additional $T_{toggle}$ time, the 2× red LEDs will turn off, and the blue LED will start flashing for $2\times T_{toggle}$ seconds to indicate it has entered into lockout mode. After the $2\times T_{toggle}$ seconds of flashing the blue led will also turn off. The switch can be released once the blue LED flashing starts.

Exceptions:

It can certainly happen that the switch is pressed by accident. Thus, if the switch is pressed as described above, but it is pressed for a full $6\times T_{toggle}$ seconds, the unit will assume the switch is being pressed by accident. Thus after $6\times T_{toggle}$ seconds of the switch being pressed, the blue LED will be flashed again for $1\times T_{toggle}$ seconds, and the unit will exit the lockout mode. The loads will remain off, and the unit will do nothing further until the switch is released. With the unit in red mode, it is also possible for the switch to be pressed by accident. In this case, if the switch is continuously pressed from off mode, the Rebel LED will turn on after $T_{toggle}$ seconds, and after another Tim seconds the Rebel LED will start with gradual dimming. If the switch is pressed continuously for $6\times T_{toggle}$ seconds in this situation, it will be assumed that the switch is being pressed accidentally. Thus the load will be turned off after the $6\times T_{toggle}$ seconds, but the unit will not enter into lockout mode. Thus if the switch is released again and pressed, the light will turn on directly.

Lockout Mode Indication

If the press the switch at any time the unit is in Lockout mode, the Blue LED will flash for $T_{toggle}$, but no other loads or the BPM will turn on.

Exiting Lockout Mode

To exit lockout mode, the switch must be pressed for $2\times T_{toggle}$ seconds. In this time the blue LED will flash. Once the $2\times T_{toggle}$ seconds has run out the Rebel LED will turn on for $4\times T_{toggle}$ seconds and then turn off. If the switch is released in the $4\times T_{toggle}$ seconds of the Rebel LED being on, the Rebel LED will turn off immediately, and lockout mode will be exited. The unit is now ready to operate as normal.

Exceptions:

If switch is kept pressed for $6\times T_{toggle}$ seconds while in lockout mode, the above sequence will happen for the first $4\times T_{toggle}$ seconds. The unit will realize after $6\times T_{toggle}$ seconds that the switch is being pressed by accident and will enter back into lockout mode, indicating this by flashing the blue LEDs for $2\times T_{toggle}$ seconds as per normal lockout mode enter.

BPM (Battery Power Meter) Operation

BPM will have 3 levels: Green, Orange and Red for the white LEDs. The 2× red LEDs will have no BPM. BPM will only be measured with the loads on in HI Power mode and will only displayed for the first 5 seconds after turning the white load on for Green and Orange colors. If HI Power mode is selected, the BPM will continue to make measurements, to detect if the Battery level drops. The BPM will remain on for approximately three minutes when a change occurs from green to orange or from orange to red. The indicator light will automatically turn off after the prescribed time elapse.

Blocking will be used. Thus, battery levels cannot go up, only down. The only way to reset the blocking is to remove the batteries from the unit. For the two white loads two different blocking registers will be kept. Thus, it will be possible for the BPM level to be green for the one load, and red for the other load. It will also be possible to select different voltages for each loads BPM level.

User Interface Summary

| | Switch |
|---|---|
| SW Input Modes | Non-latching<br>Gradual Dimming Rebel LED<br>Gradual Dimming 2 × 5 mm white LED<br>Flashing Mode 2 × 5 mm white LED<br>Gradual Dimming 2 × red LED<br>Flashing Mode 2 × red LED |

Loads

Unless stated differently, all specifications are at 25° Celsius at supply voltage 4.5 Volt.

TABLE 5

Electrical and Timing specifications

| Description | Abbreviation | Min | Typical* | Max | Unit |
|---|---|---|---|---|---|
| **General** | | | | | |
| Supply Voltage† | Vsupp | 2.4 | | 5.7 | V |
| Cell size (Alkaline or Lithium or NiMH) | | | AAA | | |
| Operating temperature† | | −20 | | 80 | ° C. |
| OFF mode average Current | | | TBA | | μA |
| **Load Specification** | | | | | |
| Main Load HI current | | | TBA | | mA |
| Main Load HI $V_{forward}$ | | | TBA | | V |
| Secondary Load HI current | | | TBA | | mA |
| Secondary Load HI $V_{forward}$ | | | TBA | | V |
| **General Timing** | | | | | |
| On/Off Time | $T_{dim}$ | | 655 | | mS |
| Toggle colour time | $T_{toggle}$ | | 1600 | | mS |
| Ramp Down Time | $T_{ramp\ down}$ | | 2100 | | mS |
| Ramp Up Time | $T_{ramp\ up}$ | | 2100 | | mS |
| Flash Time | $T_{flash}$ | | 20 | | mS |
| High Time | $T_{high}$ | | 1000 | | mS |
| Low Time | $T_{low}$ | | 1000 | | mS |
| Battery bounce time reset time (Main Load HI) | | | TBA | | mS |
| **Timing Power Levels** | | | | | |
| PWM Period | | −30% | 2.048 | +30% | mS |
| PWM Duty Cycle (min) | $PWM_{min}$ | | 1.6 | | % |
| PWM Duty Cycle (max) (HI Power) | | | 100 | | % |

*Parameters for which Min/Max values are not specified are not tested during production.

†Not tested during production

TABLE 6

| BPM Levels for Ioads | | | | | |
|---|---|---|---|---|---|
| Load | Level | Min | Typical | Max | Unit |
| Main LED | Green to Orange | | 3.2 | | V |
| Load | Orange to Red | | 2.7 | | V |
| 5 mm White LED | Green to Orange | | 3.3 | | V |
| | Orange to Red | | 2.7 | | V |

It should be noted that various alternative illumination system designs may be practiced in accordance with the present invention, including one or more portions or concepts of the embodiment illustrated in FIGS. 1A, 1B, 2 and/or the technical appendix described above. Various other embodiments have been contemplated, including combinations in whole or in part of the embodiments described above.

What is claimed is:

1. A portable illumination system comprising:

at least one light source;

an electrical power source;

a first activated state in which the electrical power source is coupled to the at least one light source to generate a first optical output;

a deactivated state in which the electrical power source is not coupled to the at least one light source and no optical output is generated;

a locked state in which the electrical power source is not coupled to the at least one light source and no optical output is generated;

a switching mechanism configured to receive both a first and second physical user input;

a processor coupled to the switching mechanism, the processor configured to select one of the first activated state, the deactivated state, and the locked state in response to one of the first and second physical user input;

wherein the processor is configured to correlate the first physical user input with a state change between the first activated state and the deactivated state; and wherein the processor is configured to correlate only the second physical user input with a state change between the locked state and either one of the first activated state or the deactivated state.

2. The portable illumination system of claim 1, wherein the first activated state further includes a second activated state comprising an electrical coupling between the electrical power source and the at least one light source, wherein the second activated state includes generating a second optical output via the at least one light source, and wherein the second optical output includes a spectral wavelength difference with respect to the first optical output.

3. The portable illumination system of claim 1, wherein the first optical output further includes a plurality of sub-outputs including variations in frequency and illumination.

4. The portable illumination system of claim 1, wherein the electrical power source is a direct current battery.

5. The portable illumination system of claim 1, wherein the optical output device includes a plurality of light emitting diodes configured to generate a plurality of optical outputs.

6. The portable illumination system of claim 1, wherein the switching mechanism is a push button mechanism, and wherein the first physical user input is a short push, and wherein the second physical user input is a long push.

7. The portable illumination system of claim 1, wherein the processor is configured to correlate the first active state and a long push with a state change to the deactivated state and a short push with a state change to the locked state.

8. The portable illumination system of claim 1, wherein the processor is configured to correlate the deactivated state and a long push with a state change to the first activated state and a long push with a state change to a second activated state.

9. The portable illumination system of claim 1, wherein the processor is configured to correlate the locked states and a restricted response within which only a long push is correlated with a state change to the first activated state.

10. The portable illumination system of claim 1, further includes a housing and a printed circuit board, and wherein the printed circuit board is disposed within the housing.

11. The portable illumination system of claim 1, further includes an elastic strap configured to be selectively coupled around a user's head.

12. A portable illumination system comprising:

at least one light source;

an electrical power source;

a first activated state in which the electrical power source is coupled to the at least one light source to generate a first optical output;

a deactivated state in which the electrical power source is not coupled to the at least one light source and no optical output is generated;

a locked state in which the electrical power source is not coupled to the at least one light source and no optical output is generated;

a switching mechanism configured to receive both a first and second physical user input, wherein the first physical user input is a short push, and wherein the second physical user input is a long push;

a processor coupled to the switching mechanism, the processor configured to select one of the first activated state, the deactivated state, and the locked state in response to one of the first and second physical user input;

wherein the processor is configured to correlate the first physical user input with a state change between the first activated state and the deactivated state; and wherein the processor is configured to correlate only the second physical user input with a state change between the locked state and either one of the first activated state or the deactivated state.

13. The system of claim 12, wherein the first activated state further includes a second activated state comprising an electrical coupling between the electrical power source and the at least one light source, wherein the second activated state includes generating a second optical output via the at least one light source, and wherein the second optical output includes a spectral wavelength difference with respect to the first optical output.

14. The system of claim 13, wherein the processor is configured to correlate the deactivated state and the first and second physical user inputs with direct state changes into the first and second optical outputs.

15. A method for switching between operational states of a portable illumination system in response to two different physical user inputs, comprising the acts of:

providing a portable illumination system comprising at least one light source, an electrical power source, a plurality of operational states comprising at least one activated state in which the electrical power source is coupled to the at least one light source to generate a first optical output, the deactivated state in which the electrical power source is not coupled to the at least one light source and no optical output is generated, and the locked state in which the electrical power source is not coupled to the at least one light source and no optical output is generated, and a processor coupled to a switching mechanism, the processor configured to receive both a first and second user input;

engaging the portable illumination system in the first activated state and configuring the portable illumination system to cause a state change between the plurality of operational states in response to receiving at least one of the first and second user input;

engaging the portable illumination system in the deactivated state and configuring the portable illumination system to cause a state change between the plurality of operational states in response to receiving at least one of the first and second user input; and engaging the portable illumination system in the locked state, and configuring the portable illumination system to cause a state change between the plurality of operational states in response to only receiving the second user input.

16. The method of claim 15, wherein the method further includes the act of engaging the portable illumination system in a second activated state, configuring the portable illumination system to cause a state change between the plurality of operational states in response to receiving at least one of the first and second user input.

17. The method of claim 15, wherein the act of providing a portable illumination system further includes providing a push button switching mechanism configured to receive a short push first user input and a long push second user input.

18. The method of claim 15, further including the act of providing a second activated state corresponding to an electrical coupling between the electrical power source and the optical output device.

19. The method of claim 15, wherein the act of engaging the portable illumination system in a locked state, and configuring the portable illumination system to cause a state change between the plurality of operational states in response to only receiving the second user input further includes restricting the response to the first user input.

* * * * *